US006470543B1

(12) United States Patent
Kamann

(10) Patent No.: US 6,470,543 B1
(45) Date of Patent: Oct. 29, 2002

(54) METHOD OF AND APPARATUS FOR REMOVING YARN RESIDUE FROM TUBES CARRYING SAME

(75) Inventor: Edmund Kamann, Übach-Palenberg (DE)

(73) Assignee: Vetrotex Deutschland GmbH, Herzogenrath (DE)

( * ) Notice: Subject to any disclaimer, the term of this patent is extended or adjusted under 35 U.S.C. 154(b) by 6 days.

(21) Appl. No.: 09/621,105

(22) Filed: Jul. 21, 2000

(30) Foreign Application Priority Data

Jul. 27, 1999 (EP) ..... 99114226

(51) Int. Cl.[7] ..... B65H 73/00
(52) U.S. Cl. ..... 28/295; 28/292
(58) Field of Search ..... 28/292, 295, 294, 28/293, 296, 297; 57/300, 304, 305, 306; 15/302, 306.1, 301, 309.1, 319, 320, 322, 312.1; 134/14, 15, 16, 34, 37, 66, 142, 144, 151, 153

(56) References Cited

U.S. PATENT DOCUMENTS

| | | | | | |
|---|---|---|---|---|---|
| 1,532,349 | A | * | 4/1925 | Schofield | 28/294 |
| 1,711,429 | A | * | 4/1929 | Senn | 29/292 |
| 1,739,775 | A | | 12/1929 | Baker | |
| RE19,673 | E | * | 8/1935 | McKillop | 28/292 |
| 2,149,778 | A | * | 3/1939 | Kimbirl | 28/294 |
| 2,303,048 | A | | 11/1942 | Hudson | |
| 2,617,172 | A | | 11/1952 | Henry | |
| 2,834,090 | A | * | 5/1958 | Vowles | 28/294 |
| 3,414,955 | A | * | 12/1968 | Courtney et al. | 28/295 |
| 3,429,745 | A | | 2/1969 | Black, Jr. | |
| 3,640,163 | A | | 2/1972 | Giardini et al. | |
| 3,803,673 | A | | 4/1974 | Kupper | |
| 3,910,021 | A | * | 10/1975 | Van Petten | 28/295 |
| 3,966,591 | A | | 6/1976 | Hinton et al. | |
| 4,035,882 | A | | 7/1977 | Ferguson et al. | |
| 4,097,976 | A | | 7/1978 | Ferguson et al. | |
| 4,208,865 | A | | 6/1980 | Koella, III | |
| 4,594,845 | A | | 6/1986 | Matsui | |
| 4,697,298 | A | | 10/1987 | Mulligan | |
| 4,765,043 | A | | 8/1988 | Yamashita | |
| 4,793,036 | A | | 12/1988 | Nakayama | |
| 4,936,086 | A | | 6/1990 | Carter et al. | |
| 4,965,917 | A | | 10/1990 | Ferguson | |
| 5,177,950 | A | | 1/1993 | Fowler, Jr. et al. | |
| 5,179,769 | A | | 1/1993 | Ferguson | |
| 5,220,714 | A | | 6/1993 | Sanno | |
| 5,231,744 | A | | 8/1993 | Ohta | |
| 5,244,504 | A | | 9/1993 | Watson | |
| 5,247,952 | A | | 9/1993 | Ferguson, Sr. | |
| 5,319,917 | A | | 6/1994 | Bothner et al. | |
| 5,345,649 | A | | 9/1994 | Whitlow | |
| 5,451,266 | A | | 9/1995 | Kirk et al. | |
| 5,483,871 | A | | 1/1996 | Kirk et al. | |
| 5,666,996 | A | | 9/1997 | Bollier et al. | |
| 5,687,461 | A | | 11/1997 | Kohlen | |
| 5,732,544 | A | | 3/1998 | Ferguson, Sr. | |
| 5,918,610 | A | | 7/1999 | Tate et al. | |
| 5,979,473 | A | | 11/1999 | Tate et al. | |

* cited by examiner

*Primary Examiner*—Amy B. Vanatta
(74) *Attorney, Agent, or Firm*—Herbert Dubno

(57) ABSTRACT

The invention concerns a method of removing thread residues which are found on a tube.

According to the invention the method is characterized in that a water jet operates on the surface of the tube.

The invention further relates to an apparatus for removing thread components found ion at least one tube.

According to the invention the apparatus is characterized in that it includes at least one nozzle that is so arranged in the liquid jet emerging from the nozzle is trained at at least one location on the surface of the tube.

5 Claims, 3 Drawing Sheets

METHOD OF AND APPARATUS FOR REMOVING YARN RESIDUE FROM TUBES CARRYING SAME

FIELD OF THE INVENTION

The invention relates to a method of removing yarn residues from tubes on which such yarn residues are found and to an apparatus for carrying out the method.

BACKGROUND OF THE INVENTION

The tubes have the configuration of hollow bodies. Because of their function, they are also known as yarn bobbins. They are a conventional means for the temporary storage of a thread which is provided for example as yarn or twist. The thread can easily be unwound from the bobbin although in the unwinding process, thread residues remain on the tube. The amount of the thread residue remaining on the tube varies as a function of the textile machines in which the tube is used as well as the parameters of the unwinding of the thread. Indeed, while the major part of the length of the thread can be unwound residues will remain on the tube. The residual piece of thread can be individual thread segments but can also be some several hundred turns.

In a known process for the removal of thread residues the thread on the tube can be cut at least once substantially through all turns.

The thread is cut with a suitable cutting tool, for example a blade. In this case there is, however, the danger that the tube will be damaged.

OBJECT OF THE INVENTION

The invention has as its object to provide a method of the type described at the outset whereby the thread residues can be removed in the simplest possible manner.

The invention has the further object of providing an apparatus of the type described at the outset with which the process can be carried out.

SUMMARY OF THE INVENTION

According to the invention, these objects are attained and the process described at the outset is so carried out that at least a liquid jet is trained on the surface of the tube.

In an especially simple and advantageous mode of the invention in which the thread is cut by jet of a liquid under pressure, especially water, the nozzles are shiftable substantially parallel to the outer surface of the tube.

In this manner a constant angle can be maintained between the jet direction of the nozzle and the surface of the sleeve.

The subject matter of the invention is, in addition, an apparatus for removing thread residue from at least one tube which is so configured that it includes at least one nozzle which is so oriented that the liquid jet emerging from the nozzle is trained on at least one location on the surface of the tube.

Especially, the apparatus includes a fastening means which so holds one or more sleeves that one or more water jets can impinge directly on the surfaces of the tubes. The individual tubes are thereby preferably so mounted that the liquid, after impinging upon the surface of the tube or the surfaces of the tubes, can run off freely. Preferably the tubes during the process are received in a processing chamber containing normal air which optionally can contain water vapor from the water jets.

The water jet can have sufficient pressure for cutting through the thread and preferably so selected that the surface of the tube is undamaged.

The water jet can have a thickness which is substantially smaller than the surface of the tube.

For example the water jet has a thickness of several $mm^2$, or $cm^2$, while the area of the tube can be substantially greater.

It is especially advantageous that the water jet be so directed that it impinges on various impingement points which differ from one another on the surface of the tube. It is especially advantageous that the water jet be so directed that the impingement points form a continuous line.

The apparatus can include at least one nozzle which is so oriented that the liquid jet which emerges from this nozzle is directed at least against one location on the surface of the tube.

The nozzles can be shiftably mounted substantially parallel to an outer surface of the tube.

It is especially advantageous that the nozzles be shiftably mounted substantially perpendicular to the travel direction of the thread.

It is especially advantageous that the jet nozzle be so mounted that they have a jet direction in which the jet impinges on the surface segment of the tube turned toward the nozzle at an angle between 25° and 75°, advantageously between 35° to 45°.

As a result there is an effective displacement of the thread from the cutting zone with simultaneous avoidance of an excessively high liquid pressure on the surface of the tube.

It is especially advantageous that the nozzles be mounted to be shiftable substantially parallel to the travel direction of the thread. As a result a straight cutting line is achieved.

BRIEF DESCRIPTION OF THE DRAWING

Further advantageous features and preferred details of the invention are given in the dependent claims and the following description of a preferred embodiment of the invention in conjunction with the drawing. The drawing shows:

SPECIFIC DESCRIPTION

Figure 1:
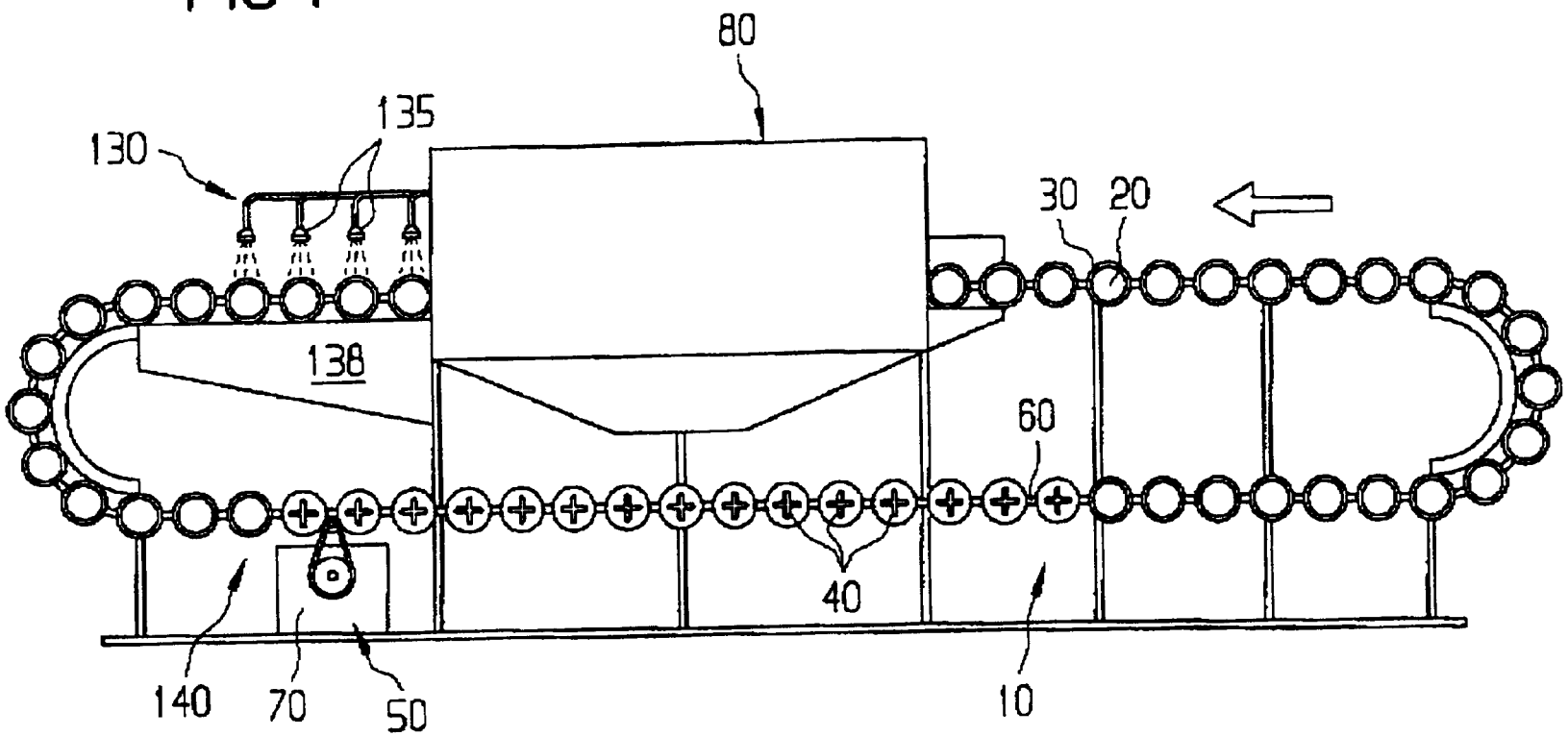
FIG. 1 a cross section through the cutting device according to the invention.

The cutting device shown in FIG. 1 comprises a mounting station 10 in which tubes 30 having openings 20 can be fitted onto mandrels 40.

The mandrels 40 are matched in size to the openings in the tubes.

The tubes 30 usually have standardized dimensions.

Preferably the opening 20 is sufficiently large that the tubes have the configuration of hollow bodies. The mounting of the tubes 30 on the mandrels 40 can be effected in various ways, whereby the structural cost is especially low in the case of a manual mounting.

The mandrels 40 are transported by a suitable conveyor 50. In the illustrated especially robust embodiment, the conveyor 50 has a conveyor belt 60 and a motor 70. The configuration of the conveyor 50 with a conveyor belt 60 and a motor 70 has the advantage that only a single motor 70 is required to drive the conveyor belt 60. In this case, all mandrels 40 are driven in common.

Preferably the conveyor belt 60 is a continuous endless belt extending over the entire working station.

The conveyor 50, can, however, also be configured in other ways, for example, the individual mandrels 40 can be transported on carriers, especially of a slide shape.

The working station has as a further component a separating or cutting station 80. The separating or cutting station 80 is arranged in the travel direction of the belt to follow mounting station 10.

For reduction of the spatial requirements it is advantageous to so arrange the transport belt that the cutting station is located in the mounting station 10.

The separating or cutting station 80 has at least one and preferably a plurality of nozzles which are mounted to be shiftable perpendicularly to the main axis of the mandrels 40 and thus also perpendicular to the main axis of the tubes 30 found on the mandrels 40.

Figure 2:
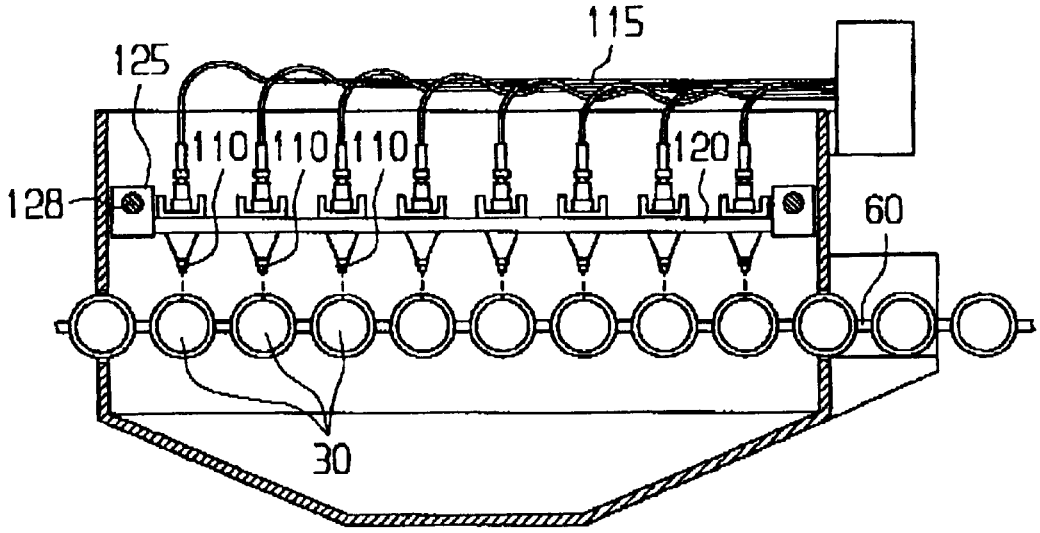
FIG. 2 a detailed elevational view of the device shown in FIG. 1.
Figure 3:
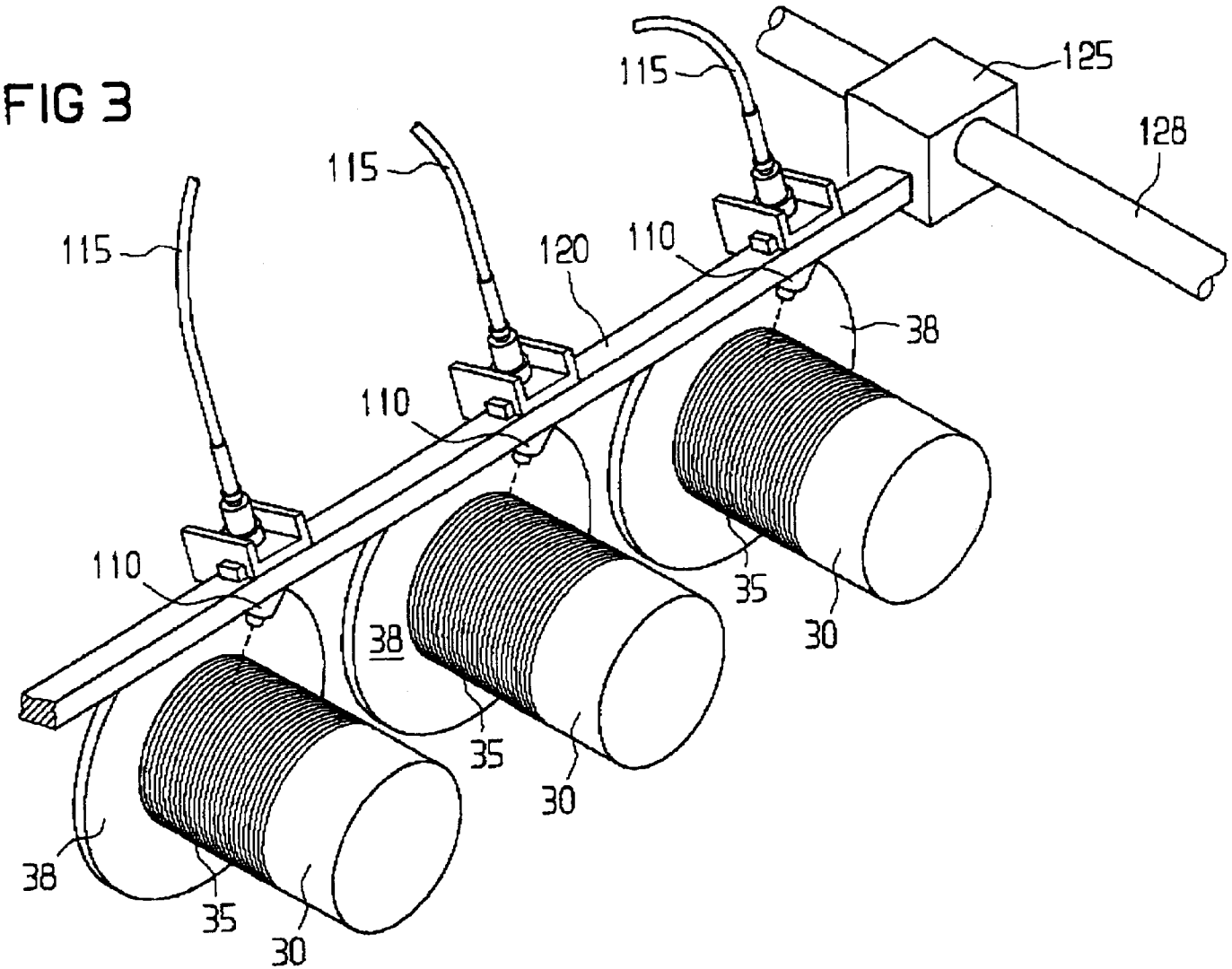
FIG. 3 a plan view of the device shown in FIG. 2 along a line III—III.

In the case of FIGS. 2 and 3, the cutting station has eight nozzles 110 arranged next to one another. The nozzles 110 have angles with respect to the axes of the mandrel of 35° to about 45°.

Water is supplied to the nozzles 110 through hose 115. The nozzles 110 are arranged collectively on a rod 120. As a result all of the nozzles 110 can be shifted together.

The rod 120 is shiftably mounted via two guide bodies 125 on two guide rails 128.

It is especially advantageous in carrying out the invention that the mandrels 40 be advanced periodically so that as many tubes can be treated in the cutting station 80 as correspond to the number of nozzles 110 in the cutting station 80.

The nozzles 110 are comprised of a nonoxidizing material, especially stainless steel. In carrying out the process, the jets are directed against the side of the tube which is turned away from the disc-shaped enlargement ("hat brim") 38 of the tubes 30.

The nozzles 110 are then so moved that the water jet is displaced parallel to the surface up to the beginning of the "hat brim". Then the nozzles 10 are displaced back although it has been found to be advantageous not to move the nozzles 110 fully back. As a result damage to the tube surface is avoided.

Following the cutting station 80 is a cleaning station 130 in which the thread residues previously cut through are washed away. An effective cleaning in conjunction with a limited water consumption is achieved in that appropriate spray devices 135 are arranged in the cleaning station 130. Below the spray devices 135, a collection basin 138 is arranged in which the water from the spray devices 135 is collected.

It is advantageous that in the cutting station 80 and/or in the cleaning station 130 the water used, after impinging upon the tubes, is collected and then utilized in a new cutting procedure. For example, below the cutting station 80 a collection basin (not shown) is arranged. Advantageously, the water can be cleaned by a suitable sieve.

Following the cutting station there is a removal station 140. An especially compact configuration of the cutting station is achieved when a manual removal of the tubes 30 is provided. It is, however, equally possible to remove the tubes 30 in the removal station 140, for example, by gripper devices. With the aid of the illustrated apparatus the process is carried out as follows:

In the mounting station 10 the tubes 30 are fitted on the mandrels 40. Then the transport belt is advanced by as many positions as correspond to the number of tubes which are simultaneously to be freed from thread residues in the cleaning station 130.

After as many tubes are introduced into the cleaning station as corresponds to the number of process places in the station, the cutting process is carried out as follows.

Via at least one commercial valve which has not been shown to save space, water under pressure is fed via hoses 115 to the nozzles 110. The nozzles 110 are displaced above the tubes 30 preferably substantially parallel to the surfaces of the tubes 30.

The nozzles 110 are so moved that the water jets are displaced parallel to the surfaces of the tubes 30 up to the disc-shaped enlargements, so called "hat brims" 38. Then the nozzles are returned through about half the previous stretch and the water supply to the nozzles 110 is interrupted. Thus damage to the tube surfaces is avoided. After processing in the cutting station 80 the tubes 30 are transported into a cleaning station 130. The cleaning station 130 contains conventional spray heads 135 from which water is sprayed onto the tubes 30. Thread residues which remain from the cutting process on the surface of the tubes 30 is thus removed. Then the tubes 30 are displaced into the removal station 140.

REFERENCE CHARACTER LIST

10 Mounting Station
20 Opening
30 Tube
38 Enlargement
40 Mandrel
50 Conveyor
60 Transport Belt
70 Motor
80 Cutting Station
110 Nozzles
115 Hose
120 Rod
125 Guide Body
128 Guide Rail
130 Cleaning Station
135 Spray Head
138 Collecting Basin
140 Removal Station

What is claimed is:

1. A method of removing yarn residues from bobbin tubes comprising the steps of:

mounting a multiplicity of bobbin tubes on respective holders of a conveyor;

displacing a plurality of said bobbin tubes into a cutting station along said conveyor so that a given number of said bobbin tubes are located simultaneously in said cutting station;

directing from a number of nozzles in said cutting station equal to said given number respective cutting jets of water against surfaces of respective bobbin tubes to cut through yarn residues on said tubes;

entraining all of said nozzles on a common rod axially along said bobbin tubes whereby said jets are moved substantially along lengths of the tube in said cutting station; and removing yarn residues which have been cut through by said jets from the respective bobbin tubes.

2. The method defined in claim 1 wherein said conveyor is displaceable from a mounting station at which said bobbin tubes are mounted on said holders to said cutting station and from said cutting station to a removable station at which said yarn residues are removed from the respective bobbin tubes.

3. The method defined in claim 2 wherein said water jets have thicknesses substantially less than a surface of the respective bobbin tubes.

4. The method defined in claim 3 wherein said conveyor moves said bobbin tubes through said cutting station in a direction substantially perpendicular to axes of said bobbin tubes and a direction of displacement of said nozzles on said rod.

5. The method defined in claim 4 wherein said jets are oriented so that each jet impinges on a surface segment of said tube at an angle of 25° to 75° to the respective nozzle.

* * * * *